US006513605B1

(12) United States Patent
Lödden

(10) Patent No.: US 6,513,605 B1
(45) Date of Patent: Feb. 4, 2003

(54) APPARATUS FOR HANDLING PIPES IN DRILLING RIGS

(75) Inventor: Arend Lödden, Bad Bentheim (DE)

(73) Assignee: Bentec GmbH Drilling and Oilfield System, Bad Bentheim (DE)

( * ) Notice: Subject to any disclaimer, the term of this patent is extended or adjusted under 35 U.S.C. 154(b) by 0 days.

(21) Appl. No.: 09/723,106

(22) Filed: Nov. 27, 2000

(30) Foreign Application Priority Data

Nov. 26, 1999 (DE) ..... 199 56 840

(51) Int. Cl.[7] ..... E21B 19/20; E21B 19/14

(52) U.S. Cl. ..... 175/52; 175/85; 166/77.51; 414/22.63

(58) Field of Search ..... 175/209, 85, 52; 81/57.21, 57.34; 166/77.51; 414/22.54, 22.57, 22.58, 22.61, 22.62, 22.63, 22.65

(56) References Cited

U.S. PATENT DOCUMENTS 2,531,930 A * 11/1950 Woolslayer et al.
2,966,994 A * 1/1961 Wolff
3,563,392 A * 2/1971 Wilson
RE29,541 E * 2/1978 Russell
4,077,525 A * 3/1978 Callegari et al.
4,380,297 A * 4/1983 Frias
4,610,315 A * 9/1986 Koga et al.
4,738,321 A * 4/1988 Olivier
4,744,710 A * 5/1988 Reed
4,850,439 A * 7/1989 Lund
5,503,234 A * 4/1996 Clanton

FOREIGN PATENT DOCUMENTS

EP 245 394 11/1987
EP 881 352 12/1998
EP 0881352 A2 * 12/1998 ..... E12B/19/20

* cited by examiner

*Primary Examiner*—David Bagnell
*Assistant Examiner*—Daniel P Stephenson
(74) *Attorney, Agent, or Firm*—Cohen, Pontani, Lieberman & Pavane

(57) ABSTRACT

The invention relates to a method and an apparatus for handling pipes, such as rods and drilling strings, in drilling rigs and drilling installations for sinking boreholes, in particular on hydrocarbon reservoirs. The apparatus according to the invention for handling pipes and drilling strings in a drilling installation having a steelwork structure with a set-down platform, a working platform, a lifting device, a drill drive and a pipe connecting device is defined in particular by the fact that there is arranged on the drilling installation a wireline, a two-axis crane which is connected to the wireline and to the steelwork structure and an extension element, which is arranged on the outside of the racking platform and has a passage to the racking platform, and also by the fact that a set-down and make-up device, arranged beside or on the working platform, is provided for vertical pipes, it being possible for the set-down and make-up device to be accessed by the wireline.

10 Claims, 5 Drawing Sheets

APPARATUS FOR HANDLING PIPES IN DRILLING RIGS

BACKGROUND OF THE INVENTION

1. Field of the Invention

The invention relates to a method and an apparatus for handling pipes, such as rods and drilling strings, in drilling rigs and drilling installations for sinking boreholes, in particular on hydrocarbon reservoirs.

2. Description of the Related Art

Boreholes on hydrocarbon reservoirs are generally sunk discontinuously since, after a joint length has been drilled, the drilling operation has to be interrupted in order to attach a further joint, with which the drilling operation can then be continued. In addition, the disassembly of the drilling string or the installation and disassembly of bore hole casings are also discontinuous, since the operation has to be interrupted each time in order to join the appropriate pipes or drilling rods to the drilling string or the casing string, or to detach them. If drilling strings comprising two or three rods or pipes are put together or separated again into individual rods or pipes, this is also carried out over the bore hole. Therefore, during this operation, drilling cannot be continued, nor can further drilling joints or casings be drawn. Normal drilling rods reach a length of approximately 9 meters, a triple drilling string (triple stand) reaches about 27 meters.

Because of increasing pressure on costs, there is a requirement of the operator of drilling installations to replace the discontinuous operation of sinking boreholes or pulling drilling strings and casings by a quasi-continuous sequence.

In the stationary onshore drilling installation UTB-1 (Forschung, Planung und Betrieb [Research, Planning and Operation], Volume 18, 1993), handling systems were used with which drilling strings were pivoted over the bore hole not by means of the hook of the drilling installation itself but by a self-contained joint handling system.

In addition, pipe racking systems are known, for example those from Maritime Hydraulics, which feed drilling strings to the drilling installation by means of three-arm systems or a bridge crane on the racking platform. The drawback with this joint handling system is that the derricks have to be suitable, in particular with regard to their static strength and their weight, to integrate these handling systems. Retrofitting or fitting them to already existing, in particular lightweight, derricks belonging to drilling installations is not possible with these handling systems. In addition, these handling systems entail high investment costs.

SUMMARY OF THE INVENTION

It is therefore an object of the invention to specify a handling method and an apparatus for handling drilling strings with which already existing drilling installations, in particular those of lightweight design, can be retrofitted, or else to equip new drilling installations with them cost-effectively. In addition, it is an object to prepare drilling strings in an operation parallel with the drilling operation, in order to accelerate the installation and therefore the drilling operation as a whole.

The apparatus according to the invention for handling pipes and drilling strings in a drilling installation having a steelwork structure, e.g., a derrick with a set-down platform, a working platform, a lifting device, a drill drive and a pipe connecting device is characterized in particular by the fact that there is arranged on the drilling installation a wireline, a two-axis crane which is connected to the wireline and to the steelwork structure, and an extension element, which is arranged on the outside of the racking platform and has a passage to the racking platform, and by the fact, that a set-down and make-up device, arranged beside or on the working platform, is provided for vertical pipes, it being possible for the set-down and make-up device to be accessed by the wireline.

With the apparatus according to the invention, there is the possibility of retrofitting existing drilling installations in order to increase the drilling installation performance and working safety by means of the parallel preparation of double or triple drilling strings, since the handling and make-up time runs in parallel with the normal drilling time, and therefore the overall time for the drilling operation is shortened.

In addition, it is advantageously possible that the individual rods or drilling strings can be sorted during the drilling activities, without being exposed to the risk of colliding with the rotating drilling string.

One advantageous refinement of the invention provides for the wireline to comprise a winch, one or more turn rollers, a lifting wire and a lifting aid.

The set-down and make-up device for pipes advantageously has one or more rat holes and/or set-down boards, and one or more holding elements and/or guide elements, which are preferably connected to the working platform. These holding elements and guide elements secure the rods or pipes in their upper region against falling out.

In a further preferred refinement, the particularly cost-effective and flexible make-up device arranged on the set-down and make-up device preferably comprises a suspended crane on which make-up tongs are suspended.

Particular preference is given to the design of a set-down platform which comprises a frame with two opposite sectors, in each case a number of racks being arranged in the sectors and a central web (monkey board) being arranged between the two sectors. It has been shown that part of the central web should be designed to fold and/or pivot, in order to be able to sort or to move the joints within the racking platform.

A further particularly preferred refinement of the invention provides for a gripper to be arranged on that side of the central web or the set-down platform which faces the steelwork structure. Said gripper can comprise two gripper arms which grip around the joint or merely have holding elements. This gripper constitutes a transfer point for the joint between the racking platform on the one hand and the drilling area on the other hand.

In a preferred variant, a joint chute or ramp is arranged on the set-down and make-up device, so that drilling rods can be introduced into the apparatus according to the invention independently of the chute which is normally present.

The method according to the invention of handling pipes and drilling strings in drilling installations is characterized by the following method steps:

a) the lifting aid on the lifting wire is positioned above a transfer point, and b) at least one rod is set down in the set-down and make-up device, and c) a further rod is drawn by means of the lifting aid and is positioned over a rod located in the set-down and make-up device and then d) said device is lowered slightly, so that the collar and pin of the tool joints of the two rods can interengage, and e) the two rods are then firmly connected to each other, and then f) the drilling string of two rods is placed by means of the lifting aid onto a set-down space on the working platform, between two racks of the set-down or racking platform or in a gripper or holder, or is moved so close to the drill drive that the drilling string can be taken over by the elevator.

A further advantageous variant of the method is characterized by the fact that, for the purpose of producing a drilling string from three rods, between method steps b) and c) at least one second rod is set down in the set-down and make-up device, and by the fact that, after two rods have been joined to form a drilling string in accordance with method step e), said drilling string is positioned over the rod still positioned in the set-down and make-up device, and then method steps d) and e) are carried out again.

It is particularly advantageous for the transfer point selected to be the upper end of a joint chute or ramp. As a result, the rod can be connected directly to the lifting aid without needing a further device, such as a pneumatic hoist.

The refinement of the method according to the invention which provides for the connection in method step e) to be made by means of make-up tongs, the make-up tongs enclosing the upper tool joint of the lower rod and the lower tool joint of the upper rod and screwing them together.

By means of the method according to the invention, the production or preparation of one or more drilling strings can be carried out in parallel with drilling, the steel structure of the derrick being used, without impairing or delaying the drilling operation. In addition, only a small additional area is needed.

The procedure in which the method steps a) to t) are carried out in the reverse order, the rods in a drilling string being separated instead of joined, likewise leads to considerable time saving.

The pivoting or folding or displaceable front part of the central web of the monkey board frees up adequate space for the rods or drilling strings to be moved from one sector of the racking platform into the other sector of the racking platform with the aid of a lifting aid and using the two-axis crane.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
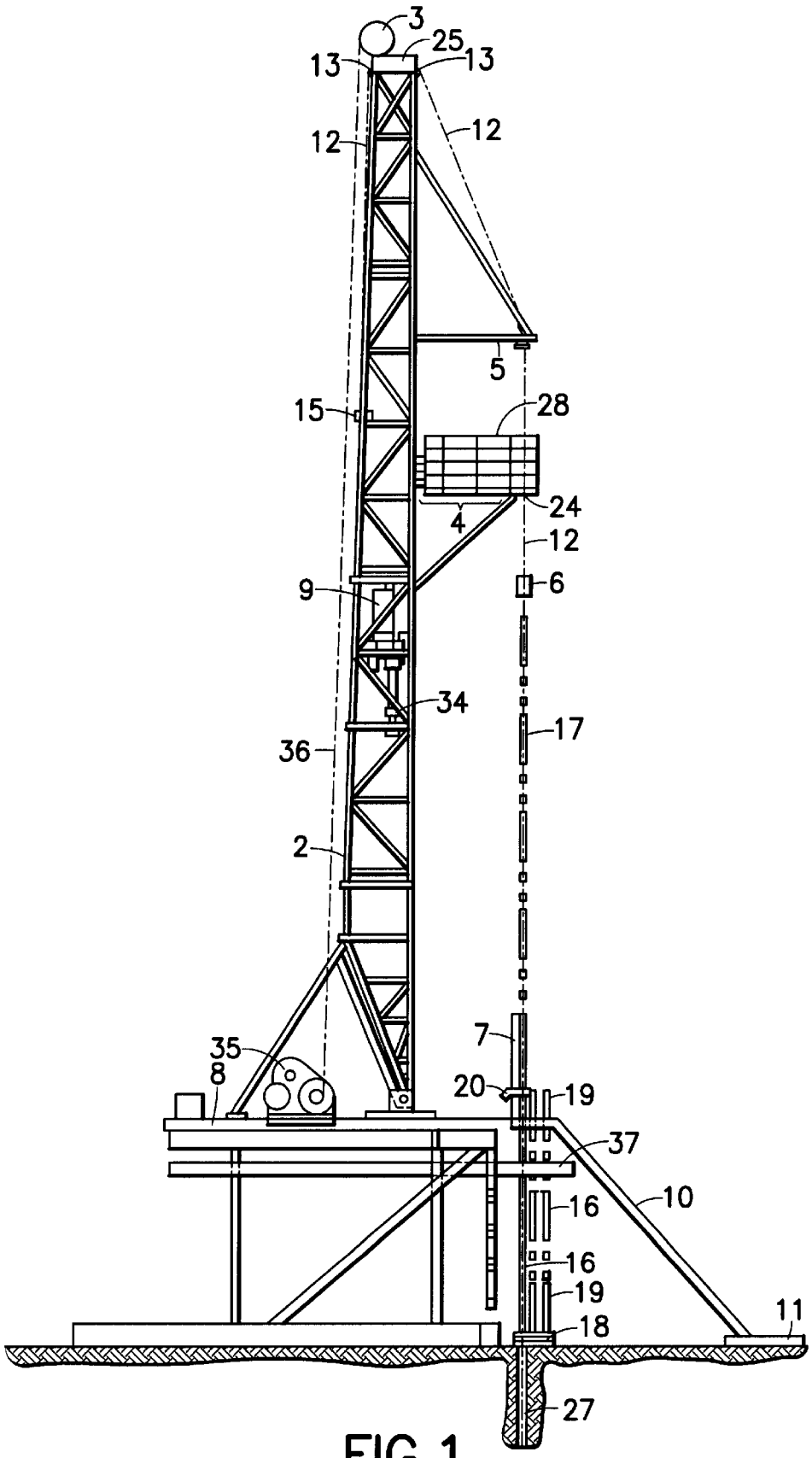
FIG. 1 is a side view of a drilling installation.

In FIG. 1, which shows the side view of a new or existing drilling installation, the additional winch 15 is arranged in the rear area of the derrick 2. The installation has a lifting device 35 with a wireline 36 that passes over a crown block 3. Via the turn rollers 13, which are arranged on the crown bearing 25, the lifting wire 12 is fed from the winch 15 to a two-axis crane 5. Above the racking platform 4 it is possible to see the two-axis crane 5, with which in this example the drilling strings 17 can be transported from the collection position on the set-down board 18 to the set-up space in the racking platform 4 and back. The two-axis crane is primarily used to guide the wire and comprises four rollers between which the wire 12 is guided, so that each point in the racking platform 4 and the extension element 24 can be moved to. Fitted to the wireline 12 is a lifting aid 6, which produces the connection to a rod 16 or a drilling string 17. In this exemplary embodiment, this lifting aid can be moved over a vertical difference of 30 meters.

The set-down boards 18 are part of a set-down and make-up device which, in this exemplary embodiment, also includes a rat hole 27 and holding or guide elements 37, an additional joint ramp 10 and a suspended crane 7 having make-up tongs 20 and an extension 21 of the working platform. Rods 16 or, in the front area, even complete drilling strings 17 can be set down on this set-down board 18. The rod 16 can be a drilling rod or a drill collar 46. However, instead of the rods 16, casings (pipes for the bore hole lining) can also be set down and put together to form strings.

According to the invention, the racking platform 4 is lengthened by an extension element 24. This extension projects beyond the substructure, that is to say the working platform (8) of the steelworker structure, and permits the drilling string 17 or a rod 16 to be lifted vertically off the set-down board 18 on the ground alongside and below the working platform. For static strength reasons, in particular, the extension element can be provided with cross struts, as in this example. Instead of rectangular designs, other geometric shapes of the extension element 24 can also be implemented. The extension element 24 is welded or screwed to the racking platform 4.

At the end of the lifting wire 12, the lifting aid 6 can be seen. The lifting aid can be equipped with a compensator, in order to relieve the load on the wire. The lifting aid is used in particular to connect the lifting wire 12 to the tool joint 19 of a rod 16 or a drilling string 17. Illustrated on the widening 21 of the working platform 8 is the suspended crane 7 with the make-up tongs 20 suspended from it, with which the individual tool joints of the rods 16 are screwed to one another.

Figure 4:
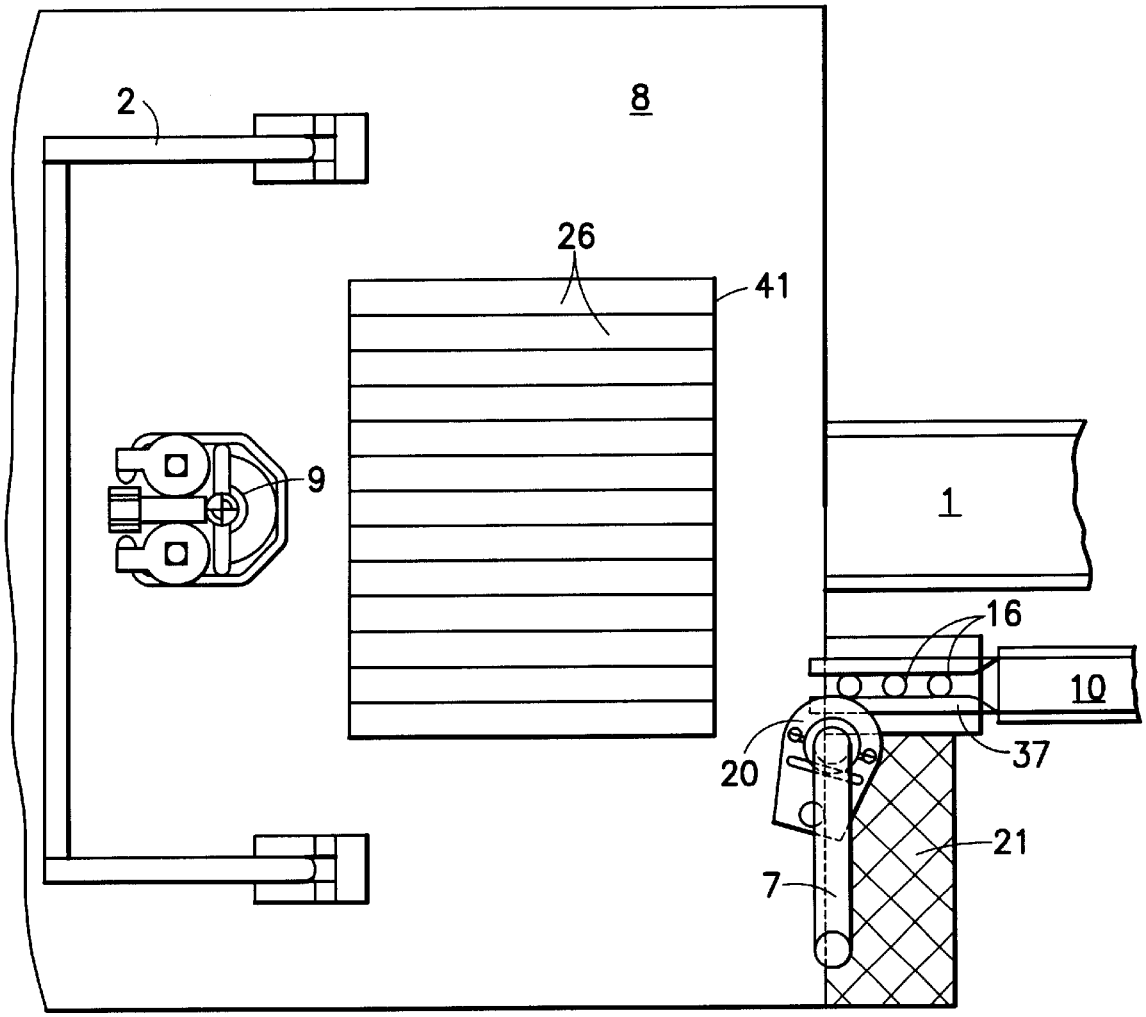
FIG. 4 is a plan view of the working platform of the drilling installation.

Shown on the ground are set-down boards 18 and a rat hole 27, for example for casings. Installed from the catwalk 11 to the working platform 8 is the additional joint ramp 10, in order to draw up individual rods 16 via a pneumatic hoist, to the pipe make-up area on the working platform as is usually present in a drilling installation, or via the lifting wire 12. The joint ramp 1 which is usual for drilling installations is illustrated in FIG. 4.

In this exemplary embodiment, the hydraulic winch 15 is used to draw up the rods 16 or the drilling string 17, said winch being arranged on the derrick 2 and connected via hydraulic hoses to a hydraulic drive (not illustrated).

However, this additional winch 15 can also be driven electrically or pneumatically. However, there is also the possibility of installing a cylinder, which likewise has the necessary stroke, horizontally in the derrick 2 or beside the derrick 2.

Figure 2:
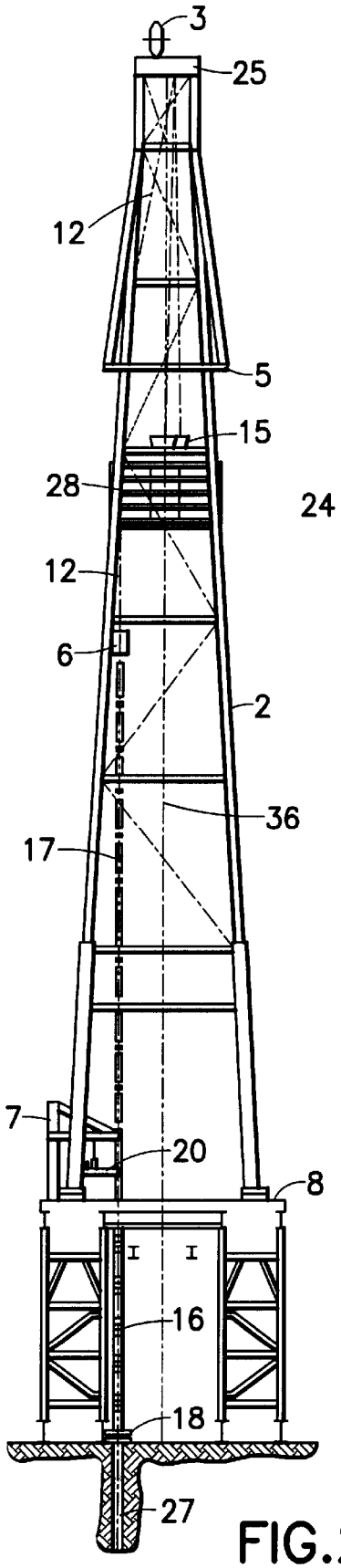
FIG. 2 is a front view of the drilling installation.

FIG. 2 shows the front view of the drilling installation with the handling apparatus according to the invention. On one side of the derrick, it is possible to see the set-down boards 18, the make-up tongs 20, which are fitted to the suspended crane 7, and the rat hole 27. In the upper area of the derrick 2 there is the two-axis crane 5, two turn rollers 13 on the crown bearing 25 and the lifting wire 12. Just above the racking platform 4, in this exemplary embodiment, there is the winch 15, on whose wireline spooler the lifting wire 12 is wound up.

Figure 3:
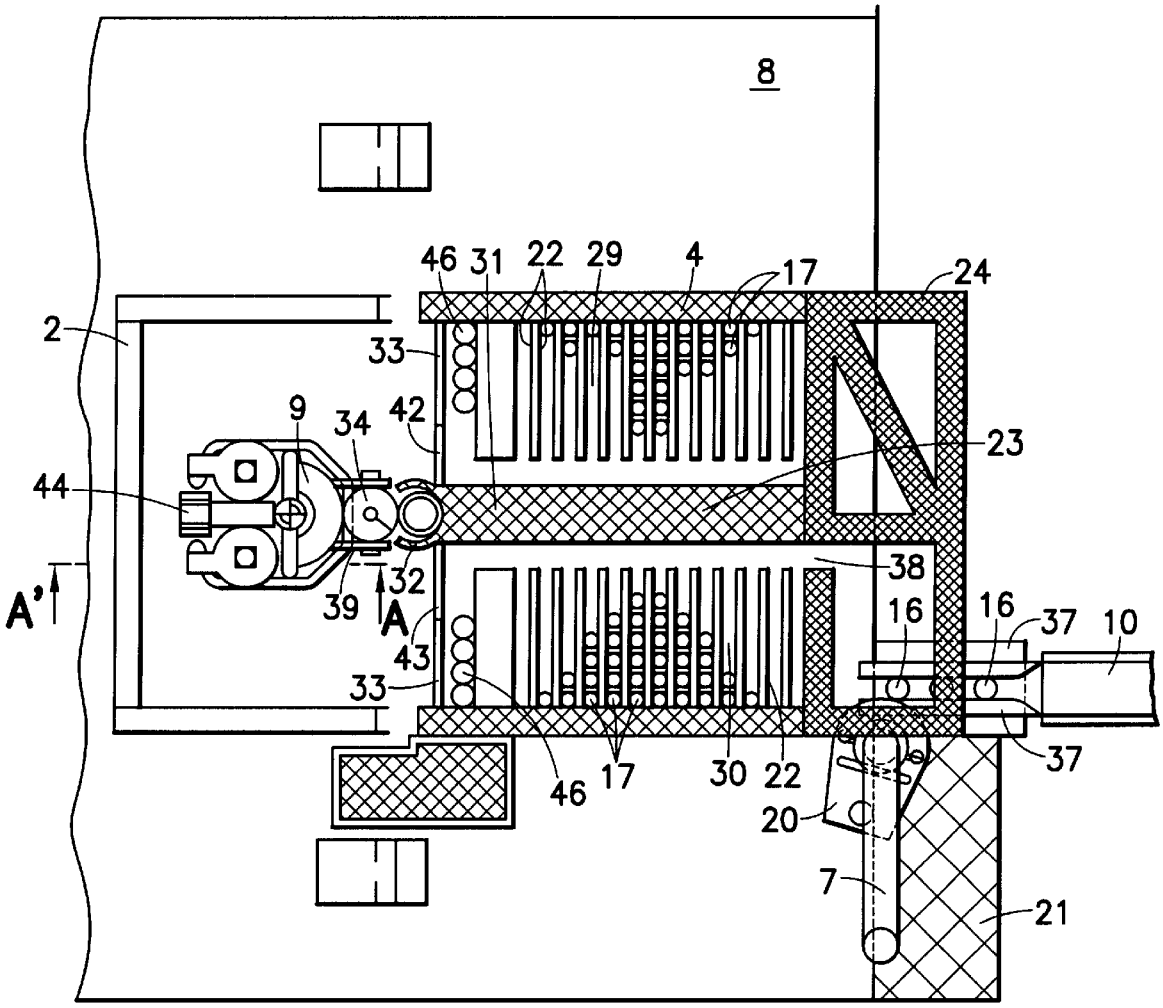
FIG. 3 is a horizontal section view taken in the plane of the racking platform of the drilling installation.

The plane of the racking platform 4 is illustrated in FIG. 3. The extension 24 of the racking platform 4 on the side opposite and facing the top drive 9 reaches beyond the working platform 8 located below it. This makes it possible to move the rods 16 or drilling strings 17 safely within a closed frame, namely that of the extended set-down or racking platform 4, and to prevent them falling out sideways. In addition, it is also possible to see in this figure the front part 31 of the central web 23 (monkey board), which can be folded here, and which permits adequate clearance for transporting the drilling strings from the first sector 29 to the other side of the racking or set-down platform 4, into the second sector 30 of the racking platform 4. Of course, the reverse transport path is also possible, in particular following the assembly of drilling strings 17.

The central web can be arranged not only such that it can be folded but also such that it can be pivoted or else displaced. The front area 31 of the central web is attached to the rear part of the central web 23, so that it can be folded upward. In the front area of the racking platform 4 there is a gripper 32, which constitutes the collection point for the elevator 34 of the top drive 9. The drilling string 17 needed for the next drilling section can be set down directly, close to the bore hole, in this gripper 32, while the drilling process is still continuing with the preceding drilling string 17. This again means that time can be saved, since the elevator 34 of the top drive 9, after being moved up, can immediately remove the next drilling string from this holding position. At the same time, the handling process becomes safer, since more time remains for the provision of a further drilling string 17.

In this exemplary embodiment, the individual drilling rods 16, which are fed to a pipe make-up area of the working platform 8 via the additional joint ramp 10 of the drilling installation or a widening 21 of the working platform and are set down there, the working platform widening being a part of the pipe make-up area where the pipes are assembled to form drilling strings 17. In connecting together pipe lengths, the tongs 20, which are fixed to the suspended crane 7 are used, the assembling being carried out together with use of the two-axis crane 5 and the lifting wire 12 guided therein, and the lifting aid 6.

FIG. 4 illustrates the plan view of the working platform 8. The additional joint ramp 10, and the set-down boards 18 with the three rods 16, are located on or under a widening 21 of the working platform 8, in order to ensure sufficient space for the individual rods 16 to be made up into a drilling string 17. The three rods 16 illustrated in this example are held in their upper area by guide elements 37.

The make-up device 20 in this example is arranged suspended on a rotatable suspension crane 7. Nevertheless, there is also the possibility of arranging a make-up device 20 directly on the working platform 8 in such a way that it can be displaced or pivoted.

Figure 5:
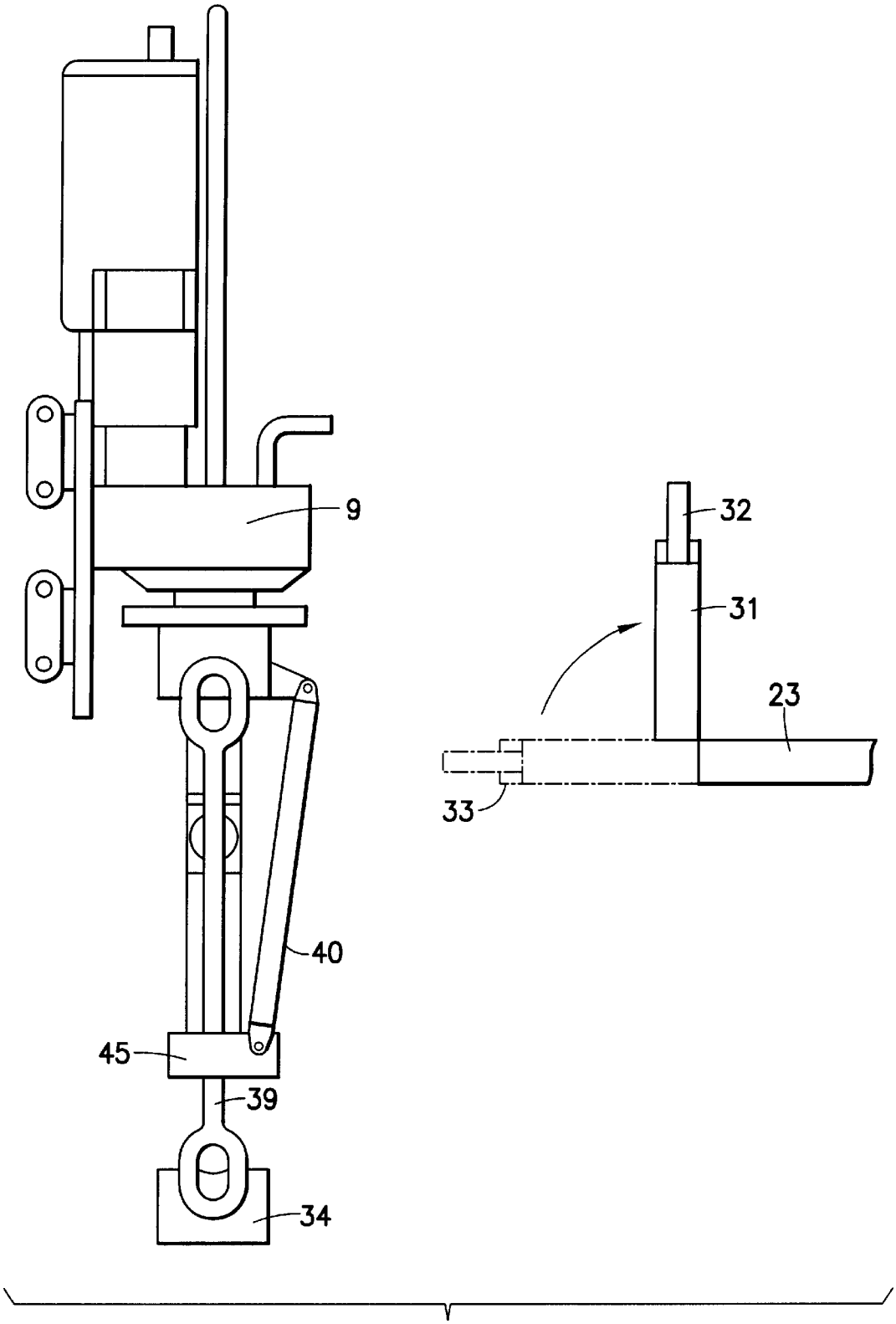
FIG. 5 is a section view taken on the line A–A' in FIG. 3.

FIG. 5 illustrates the section A–A' in FIG. 3, which shows the top drive 9 and the elevator 34 arranged on the latter. Illustrated opposite this is the front part of the racking platform 4. The front part 31 of the central web 23, which is folded upward here, is attached to the central web 23, which is screwed or welded to the racking platform 4. In this exemplary embodiment, the gripper 32 is arranged on this front part 31. The front part 31 is folded up only when a drilling string 17 (not illustrated) is to be moved from one sector of the racking platform 4 into the opposite sector. 33 designates a barrier, which is constructed in a similar way to a rack 22, but in its front part is configured such that it can be folded or withdrawn, so that it can be opened when a drilling string 17 is to be moved out of the area of the racking platform 4 into the area of the bore hole or towards the gripper 32. During operations such as the assembly of drilling strings in the area of the extension element 24 or of the racking platform 4, said barrier is normally closed, so that drilling strings are effectively prevented by it from falling out into the drilling area.

The handling method sequence will be described below:

The pipes or rods 16 are drawn up over the additional joint ramp 10 by means of a lifting wire 12, in which a lifting aid 6 is arranged in the lower area. The drawing-up action can also be brought about by means of a pneumatic hoist normally arranged on the drilling installation. The lifting wire 12 is wound or unwound on an additional winch 15 via at least one turn roller 13, which is arranged at or on the crown bearing 25. The winch 15 is preferably connected to a wireline spooler (not illustrated).

The two-axis crane 5 is parked in a collection position above a transfer point, which is located as vertically as possible above the pipe 16 to be lifted. This position prevents the rod 16 or else the subsequent drilling string 17 from being drawn transversely, and improves the safety of the apparatus. In this position, the lifting wire 12 is located in the area of the extension element 24 of the racking platform 4. By deflecting the lifting wire 12 from the vertical, it is possible to take over a pipe 16 at the upper end of the additional joint ramp 10 as well.

The first rod 16 drawn up is set down on the set-down board 18. Located in the upper area of the rods are guide elements 37, which hold the rods 16 and secure them against tilting away sideways. The second rod 16 is then drawn up in the same way over the additional joint chute 10 and set down on the set-down board 18. If a triple drilling string (triple stand) is to be constructed, a third rod is subsequently lifted and set down, likewise in the same way. By this procedure, the assembly of drilling strings of four or more rods is also possible.

Then, one of the set-down rods is lifted again by means of the lifting aid 6, to be specific to such an extent that the lower tool joint 19 of the lifted rod 16 swings over the upper tool joint 19 of the lower rod 16. This rod is held by the two-axis crane 5 above the rod 16 set down at the bottom, and is lowered only slightly, so that the collar and pin (not illustrated) of the tool joint 19 can interengage. The last rod 16 to be joined, if it has not been set down on the set-down board 18 of the set-down and make-up device by using the pneumatic hoist, can also be drawn up directly by means of the wireline connected to the two-axis crane 5, and can be positioned over a set-down rod 16.

The make-up tongs 20 then wrap around the upper tool joint 19 of the lower rod 16 and the lower tool joint 19 of the upper rod. Then, the make-up, firstly of a double drilling string (double stand) can then be carried out with the make-up tongs.

After this make-up has been carried out this double drilling string 17 can be set down in the racking platform 4, which can also be referred to as a set-down platform, or made up with a further rod 16 to form a triple drilling string 17. For this purpose, the double drilling string 17 is lifted until the lower tool joint 19 of the double drilling string swings over the tool joint 19 of the third rod 16, which is still standing on the set-down board 18. Then, as described above, the double drilling string is lowered until the pin and the collar interengage. The make-up is then carried out again using the make-up tongs 20. The triple drilling string can then be lifted and set down in the set-down or racking platform 4. Instead of a screwed make-up, other connections can also be produced between the rods 16, such as connections by means of a welding process.

The action of setting down the drilling string 17 in the racking platform 4 is ensured by the passage 38 between the extension element 24 and the frame of the racking platform 4. This passage can be designed to be about 35 cm (about 15 inches) wide.

In the case of new drilling installations, the racking platform 4 can be constructed with an extension element 24 at the factory, but in the case of existing drilling installations, the existing racking platform 4 must be modified by an extension element 24 being connected to said platform, it being necessary in any case for a passage 38 to be created on the outer frame of the racking platform, so that the lifting wire 12 with the lifting aid 6 can pass rearward out of the existing racking platform 4 into the extension element 24.

The racking platform equipped with the extension element 24 according to the invention projects beyond the substructure, the racking platform 4 generally being intrinsically self-contained, but the action of threading the installed drilling string 17 between the individual racks 22 in the racking platform is ensured at any time by means of the two-axis crane 5 and the lifting aid 6. Of course, the drilling strings 17 are able to leave the set-down platform 4 on the side facing the drilling area, for example via the open barrier 43, in order to be fed to the bore hole.

During the drilling work, there is the option of using the front part 31 of the central web 23, which can be folded in this case, in order to shorten said central web 23 with the effect that a clearance is created through which the drilling string 17 can be moved safely within the racking platform 4 but outside the hazardous area of the drilling installation. The central web 23 is connected to the racking platform 4 and/or the extension 24 of the racking platform 4. The actions of sorting or moving drilling strings 17 in the racking platform 4 outside and independently of the actual drilling operation saves time, since the drilling process can continue without disruption, and sorting operations for preparing the progress of the drilling, and disassembly work, can be carried out safely.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. Apparatus for handling pipes and drilling strings in a drilling installation, comprising:

a working platform having a pipe make-up area;

a derrick supported on said working platform;

a racking platform mounted on said derrick above said working platform, said racking platform having an extension at a rear side thereof, said extension being located above said working platform pipe make-up area;

a two-axis operation crane carried on the derrick above said racking platform;

a lifting wireline operating on said crane, said crane being postitionable over said racking platform extension to enable passing of said wireline down therethrough to said working platform pipe make-up area for connecting said wireline to pipes and drilling strings at said pipe make-up area and lifting said pipes and drilling strings to said racking platform.

2. Apparatus for handling pipes and drilling strings as claimed in claim 1, wherein the lifting wireline comprises:

a winch;

at least one turn roller on the derrick;

a lifting wire passing from the winch to the two-axis crane around said turn roller; and a lifting aid carried on the lifting wire for connecting the lifting wire to pipes and drilling strings.

3. Apparatus for handling pipes and drilling strings as claimed in claim 1, comprising a pipe set down area including pipe set down boards disposed at a ground location below and alongside said working platform, said racking platform extension being located over said pipe set down area.

4. Apparatus for handling pipes and drilling strings as claimed in claim 3, wherein a rat hole is provided in the ground below said work platform pipe make-up area for reception of casings.

5. Apparatus for handling pipes and drilling strings as claimed in claim 3, comprising a chute ramp extending from the ground to the working platform pipe make-up area along which pipes can be raised from the ground to said working platform pipe make-up area.

6. Apparatus for handling pipes and drilling strings as claimed in claim 1, comprising a suspended crane at said working platform pipe make-up area; and pipe make-up tongs carried on said suspended crane for connecting together joints of pipes.

7. Apparatus for handling pipes and drilling strings as claimed in claim 6, comprising a guide element disposed proximal said platform pipe make-up area for holding a pipe when it is being connected with another pipe.

8. Apparatus for handling pipes and drilling strings as claimed in claim 1, further comprising a drilling operation top drive in said derrick, wherein a front side of said racking platform being located proximal said derrick, said racking platform including a central web and at least one rack for racking said pipes and drilling strings at one side of said web, said extension having a passage through which pipes and drilling strings lifted from said work platform pipe make-up area can be moved for placement in said rack.

9. Apparatus for handling pipes and drilling strings as claimed in claim 8, wherein said racking platform includes another rack for racking pipes and drilling strings at an opposite side of said web, a front part of said central web being foldable away from a reminder part of said central web to provide clearance space for moving pipes and drilling strings between said at least one and said other racks and from a rack to said top drive.

10. Apparatus for handling pipes and drilling strings as claimed in claim 9, comprising a gripper device on said racking platform for gripping a drilling string incident a transfer of said drilling string from the racking platform to the drilling operation top drive.

* * * * *